US007299962B1

(12) United States Patent
Perez

(10) Patent No.: US 7,299,962 B1
(45) Date of Patent: Nov. 27, 2007

(54) NAIL DRIVING APPARATUS

(76) Inventor: Emilio N. Perez, 13748 Sproule Ave., Sylmar, CA (US) 91342

( * ) Notice: Subject to any disclaimer, the term of this patent is extended or adjusted under 35 U.S.C. 154(b) by 0 days.

(21) Appl. No.: 11/318,007

(22) Filed: Dec. 27, 2005

(51) Int. Cl.
*B25C 5/02* (2006.01)

(52) U.S. Cl. ..... 227/147; 227/119; 227/148; 173/90

(58) Field of Classification Search ..... 227/147, 227/119, 148; 173/90
See application file for complete search history.

(56) References Cited

U.S. PATENT DOCUMENTS

| | | | | |
|---|---|---|---|---|
| D262,513 | S | 1/1982 | Allen | |
| 4,367,836 | A | 1/1983 | Hodson | |
| 4,665,994 | A * | 5/1987 | Snider | 173/90 |
| 4,832,245 | A * | 5/1989 | Terayama et al. | 227/130 |
| 5,010,710 | A * | 4/1991 | Gray et al. | 52/741.14 |
| 5,316,200 | A * | 5/1994 | Wallin | 227/119 |
| 5,715,985 | A * | 2/1998 | Letson | 227/119 |
| 5,779,127 | A * | 7/1998 | Blacket et al. | 227/107 |
| 6,095,392 | A * | 8/2000 | Batts et al. | 227/8 |
| 6,098,865 | A * | 8/2000 | Tebo | 227/147 |
| 6,205,602 | B1 | 3/2001 | Dettewiler | |
| 6,213,373 | B1 * | 4/2001 | Wakai | 227/147 |
| 6,345,755 | B1 | 2/2002 | Fields | |
| 6,517,294 | B2 * | 2/2003 | Vreeland | 405/302.7 |
| 6,585,456 | B2 | 7/2003 | Forse | |
| 6,592,015 | B1 * | 7/2003 | Gostylla et al. | 227/112 |
| 6,708,860 | B1 * | 3/2004 | Thieleke | 227/8 |
| 6,796,747 | B1 * | 9/2004 | Vreeland | 405/302.7 |
| 2003/0218046 | A1 | 11/2003 | Mangone, Jr. | |
| 2003/0230621 | A1 * | 12/2003 | Yamamoto et al. | 227/113 |

* cited by examiner

*Primary Examiner*—Brian D. Nash

(57) ABSTRACT

A nail driving apparatus for maintaining alignment of a nail with an object and driving the nail into the object includes an alignment tube being configured for slidably receiving the nail and maintaining a substantially perpendicular alignment of the nail with a surface of the object. A piston rod is slidably extendable into the alignment tube to strike the nail and drive the nail into the object. A chambering member is coupled to the alignment tube. The chambering member has a chamber in communication with the alignment tube. The chamber has a bottom wall angled toward the alignment tube. The chambering member has a top wall having an insert aperture extending therethrough. The insert aperture receives the nail and the chamber guides the nail into the alignment tube when the piston rod is positioned above the chamber.

6 Claims, 2 Drawing Sheets

NAIL DRIVING APPARATUS

BACKGROUND OF THE INVENTION

1. Field of the Invention

The present invention relates to nail drivers and more particularly pertains to a new nail driver for maintaining alignment of a nail with an object and driving the nail into the object.

2. Description of the Prior Art

The use of nail drivers is known in the prior art. U.S. Pat. No. 6,585,456 describes a device for aligning an anchoring pin and driving the anchoring pin. Another type of nail driver is U.S. Pat. No. 4,367,836 for guiding a nail against concrete and driving the nail into the concrete. Another type of nail driver is U.S. Application Publication No. 2003/0218046 for being fed by a strip of fasteners and inserting each of the fasteners into a strip of substrate.

While these devices fulfill their respective, particular objectives and requirements, the need remains for a device that has certain improved features that allows an individual nail to be loaded into a loading tube positioned adjacent to and in communication with an alignment tube once the alignment tube has been positioned against an object through which a nail is to be extended. This will allow for faster nailing of the object and ensure that the nail is always positioned correctly.

SUMMARY OF THE INVENTION

The present invention meets the needs presented above by generally comprising an alignment tube being configured for slidably receiving a nail and maintaining a substantially perpendicular alignment of the nail with a surface of the object. A piston rod is slidably extendable into the alignment tube to strike the nail and drive the nail outwardly and into an object. A chambering member is coupled to the alignment tube. The chambering member has a chamber in communication with the alignment tube. The chamber has a bottom wall angled toward the alignment tube and a top wall having an insert aperture extending therethrough. The insert aperture receives the nail and the chamber guides the nail into the alignment tube when the piston rod is positioned above the chamber.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
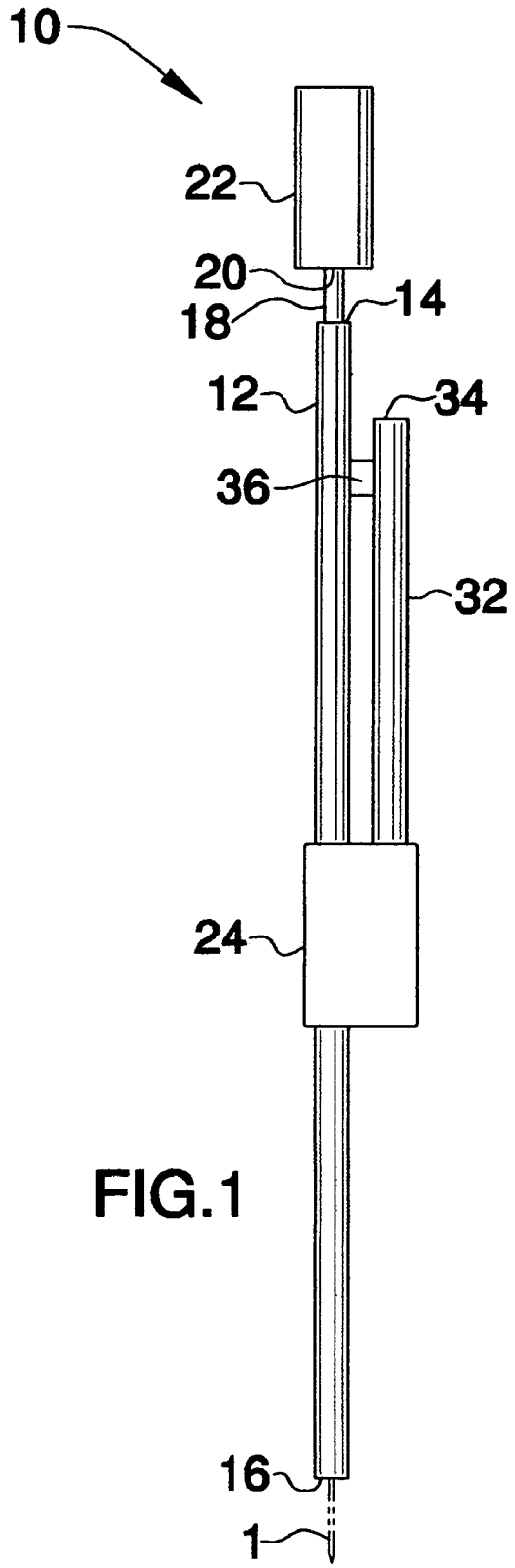
FIG. 1 is a front view of a nail driving apparatus according to the present invention.
Figure 2:
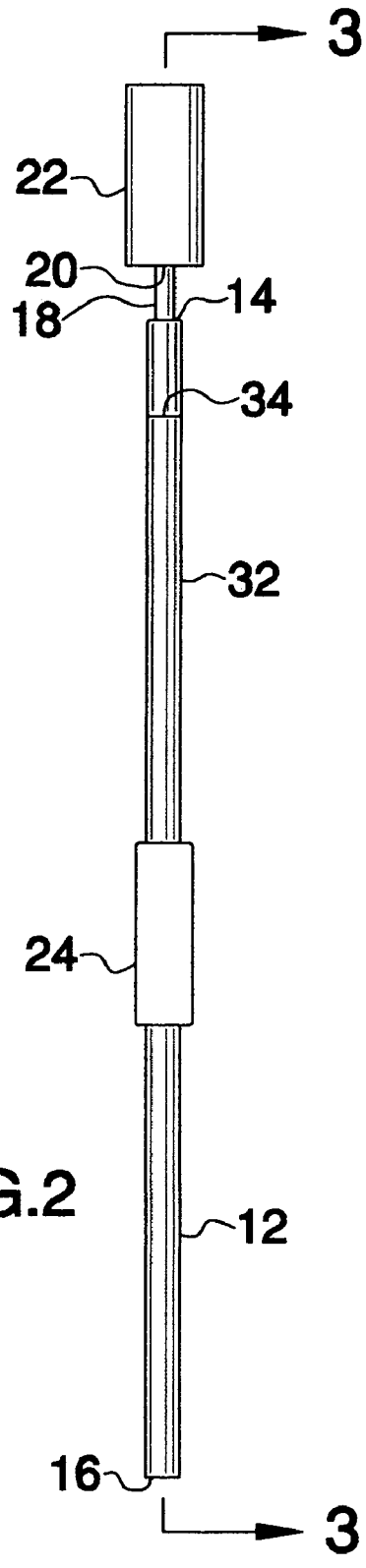
FIG. 2 is a side view of the present invention.
Figure 3:
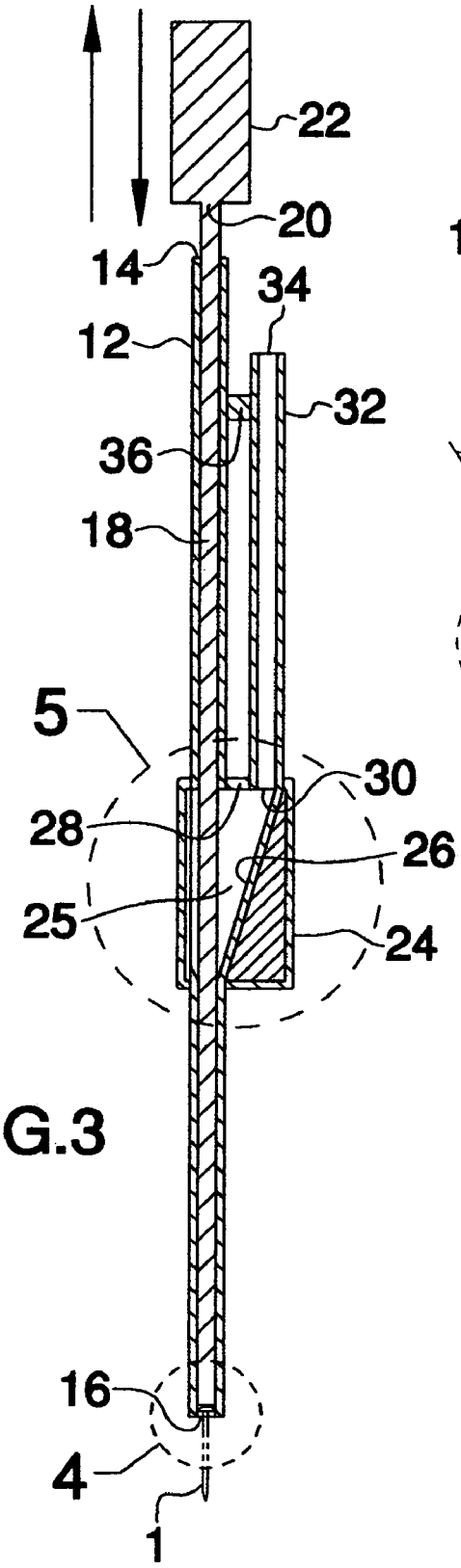
FIG. 3 is a cross-sectional view of the present invention taken along line 3-3 of FIG. 1.
Figure 4:
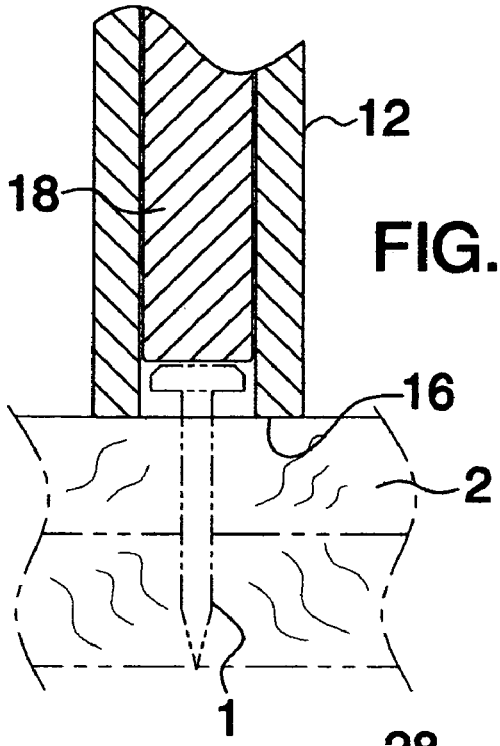
FIG. 4 is an enlarged cross-sectional view of the present invention taken from area 4 of FIG. 3.
Figure 5:
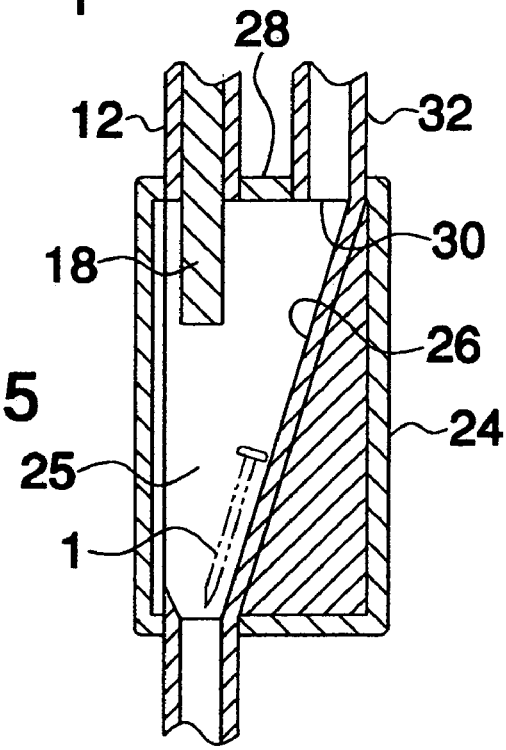
FIG. 5 is a enlarged cross-sectional view of the present invention taken from area 5 of FIG. 3.

With reference now to the drawings, and in particular to FIGS. 1 through 5 thereof, a new nail driver embodying the principles and concepts of the present invention and generally designated by the reference numeral 10 will be described.

As best illustrated in FIGS. 1 through 5, the nail driving apparatus 10 generally comprises an alignment tube 12 being configured for slidably receiving a nail 1 and maintaining a substantially perpendicular alignment of the nail 1 with a surface of an object 2. The alignment tube 12 has an open top end 14 and an open bottom end 16.

A piston rod 18 is slidably extendable into the top end of the alignment tube 12 to strike the nail 1 and drive the nail 1 outwardly of the bottom end and into an object 2. The piston rod 18 has an outer end 20 extending outwardly from the top end of the alignment tube 12. A weight 22 is coupled to the outer end 20 of the piston rod 18 to provide additional weight to the piston to facilitate driving of the nail 1 into the object 2.

A chambering member 24 is coupled to the alignment tube 12. The chambering member 24 has a chamber 25 in communication with the alignment tube 12. The chamber 25 has a bottom wall 26 being angled toward the alignment tube 12. The chambering member 24 has a top wall 28 having an insert aperture 30 extending therethrough. The insert aperture 30 receives the nail 1 and the chamber guides the nail 1 into the alignment tube 12 when the piston rod 18 is positioned above the chamber.

A loading tube 32 is coupled to the chambering member 24 and extends upwardly from the chambering member 24. The loading tube 32 is in communication with the insert aperture 30. A free end 34 of the loading tube 32 receives the nail 1 and guides the nail 1 to the insert aperture 30 of the chambering member 24. A brace 36 extends between and is attached to the alignment tube 12 and the loading tube 32 to maintain alignment of the alignment tube 12 with the loading tube 32.

In use, the bottom end of the alignment tube 12 is positioned against the object 2. The bottom end of the piston rod 18 is positioned above the chambering member 24. The nail 1 is inserted into the free end 34 of the loading tube 32 and slides down the loading tube 32 and through the insert aperture 30 of the chambering member 24. The nail 1 then slides along the bottom wall 26 and into the alignment tube 12 and slide to the bottom end of the alignment tube 12. The piston rod 18 is then dropped onto the nail 1 to drive the nail 1 into the object 2.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A nail driving apparatus for driving a nail into an object, the apparatus comprising:

an alignment tube being configured for slidably receiving the nail and maintaining a substantially perpendicular alignment of the nail with a surface of the object, said alignment tube having an open top end and an open bottom end;

a piston rod being slidably extendable into said top end of said alignment tube to strike the nail and drive the nail outwardly of said bottom end and into the object, said piston rod having an outer end extending outwardly from said top end of said alignment tube;

a weight being coupled to said outer end of said piston rod;

a chambering member being coupled to said alignment tube, said chambering member having a chamber in communication with said alignment tube, said chamber having a bottom wall being angled toward said alignment tube, said chambering member having a top wall having an insert aperture extending therethrough, said insert aperture receiving the nail and said chamber guiding the nail into said alignment tube when said piston rod is positioned above said chamber, said chambering member being capable of simultaneously holding only a single nail;

a loading tube being coupled to said chambering member and extending upwardly from said chambering member, said loading tube being in communication with said insert aperture, a free end of said loading tube receiving the nail and guiding the nail to said insert aperture of said chambering member, said loading tube having a longitudinal axis being oriented parallel with respect to a longitudinal axis of said alignment tube; and a brace extending between and being attached to said alignment tube and said loading tube.

2. A nail driving apparatus for driving a nail into an object, the apparatus comprising:

an alignment tube being configure for slidably receiving the nail and maintaining a substantially perpendicular alignment of the nail with a surface of the object;

a piston rod being slidably extend able into said alignment tube to strike the nail and drive the nail outwardly of an open bottom end of said alignment tube and into the object;

a chambering member being coupled to said alignment tube, said chambering member having a chamber in communication with said alignment tube, said chamber having a bottom wall being angled toward said alignment tube, said chambering member having a top wall having an insert aperture extending therethrough, said insert aperture receiving the nail and said chamber guiding the nail into said alignment tube when said piston rod is positioned above said chamber; and a loading tube being coupled to said chambering member and extending upwardly from said chambering member, said loading tube being in communication with said insert aperture, a free end of said loading tube receiving the nail and guiding the nail to said insert aperture of said chambering member, said loading tube having a longitudinal axis being oriented parallel with respect to a longitudinal axis of said alignment tube.

3. The apparatus according to claim 2, wherein said alignment tube has an open top end positioned opposite of said open bottom end, said piston rod being slidably extendable into said top end of said alignment tube to strike the nail and drive the nail outwardly of said bottom end and into the object.

4. The apparatus according to claim 3, wherein said piston rod has an outer end extending outwardly from said alignment tube, a weight being coupled to said outer end of said piston rod.

5. The apparatus according to claim 2, further comprising a brace extending between and being attached to said alignment tube and said loading tube.

6. The apparatus according to claim 2, wherein said piston rod has an outer end extending outwardly from said alignment tube, a weight being coupled to said outer end of said piston rod.

* * * * *